US008475036B2

(12) United States Patent
Takasawa

(10) Patent No.: US 8,475,036 B2
(45) Date of Patent: Jul. 2, 2013

(54) TIMEPIECE FACE AND TIMEPIECE

(75) Inventor: Koki Takasawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/411,954

(22) Filed: Mar. 5, 2012

(65) Prior Publication Data

US 2012/0230166 A1 Sep. 13, 2012

(30) Foreign Application Priority Data

Mar. 8, 2011 (JP) ..... 2011-050350

(51) Int. Cl.
*G04B 37/00* (2006.01)

(52) U.S. Cl.
USPC ..... 368/280

(58) Field of Classification Search
USPC ..... 368/280, 205, 223, 232, 234
See application file for complete search history.

(56) References Cited

U.S. PATENT DOCUMENTS 5,426,621 A * 6/1995 Akasaka ..... 368/226
6,982,931 B2 * 1/2006 Brewer et al. ..... 368/80
2005/0185518 A1 * 8/2005 Kawakami et al. ..... 368/232

FOREIGN PATENT DOCUMENTS

JP 10-282254 A 10/1998

* cited by examiner

*Primary Examiner* — Edwin A. Leon
(74) *Attorney, Agent, or Firm* — Global IP Counselors, LLP

(57) ABSTRACT

To provide a timepiece face created by bonding a plurality of substrates configured primarily from polycarbonate, excellent bonding strength being achieved between substrates and air bubbles being effectively prevented from forming in the bond layer, and a timepiece including the timepiece face, a timepiece face according to the invention includes a first substrate configured primarily from polycarbonate; a second substrate configured primarily from polycarbonate; and a bond layer for bonding the first substrate and the second substrate.

7 Claims, 2 Drawing Sheets

TIMEPIECE FACE AND TIMEPIECE

CROSS-REFERENCE TO RELATED APPLICATIONS

This application claims priority to Japanese Patent Application No. 2011-050350 filed on Mar. 8, 2011. The entire disclosure of Japanese Patent Application No. 2011-050350 is hereby incorporated herein by reference.

BACKGROUND

1. Technological Field

The present invention relates to a timepiece face and a timepiece.

2. Background Technology

Functionalities as a practical item, and decorative quality (aesthetic appearance) as a decorative item, are required of timepieces and timepiece faces. There are known timepiece faces created by bonding a plurality of substrates (plate-shaped members) (e.g., see Patent Citation 1). An adhesive configured from synthetic rubber has been used to bond the substrates in relation to manufacturing a timepiece face of such description.

Separately, timepiece faces made of highly transparent polycarbonate are also used for, e.g., enhancing decorative quality or increasing optical transparency for application in a timepiece including a solar cell (i.e., a solar timepiece). In an instance in which a well-known adhesive is used in a timepiece face created by bonding a plurality of substrates (plate-shaped members), air bubbles enter an adhesion layer (bond layer) between substrates and significantly lower the aesthetic appearance (artistic quality) of the timepiece face as a whole.

Japanese Laid-open Patent Publication No. 10-282254 (Patent Document 1) is examples of the related art (see paragraph number 0024).

SUMMARY

Problems to be Solved by the Invention

An advantage of the invention is to provide a timepiece face created by bonding a plurality of substrates configured primarily from polycarbonate, excellent bonding strength being achieved between substrates and air bubbles being effectively prevented from forming in the bond layer; and to provide a timepiece including the timepiece face.

Means Used to Solve the Above-Mentioned Problems

The above advantage is achieved through the invention described below. A timepiece face according to an aspect of the invention includes a first substrate configured primarily from polycarbonate;

a second substrate configured primarily from polycarbonate; and a bond layer for bonding the first substrate and the second substrate; wherein the bond layer is configured from an adhesive elastic body composition obtained by directing UV light on a UV-crosslinking acrylic resin material in an oxygen-blocked state so that crosslinking occurs, the UV-crosslinking acrylic resin material having as a main agent an acrylic acid monomer and/or oligomer; and the bond layer has a thickness of 50 μm to 200 μm, an elongation of 50% to 350%, and a light transmittance of 80% or higher in the thickness direction. It is thereby possible to provide a timepiece face created by bonding a plurality of substrates configured primarily from polycarbonate, excellent bonding strength being achieved between substrates and air bubbles being effectively prevented from forming in the bond layer.

A timepiece face according to another aspect of the invention includes a plurality of substrates configured primarily from polycarbonate; and bond layers for bonding the substrates that are adjacent; wherein the bond layers are configured from an adhesive elastic body composition directing UV light on a UV-crosslinking acrylic resin material in an oxygen-blocked state so that crosslinking occurs, the UV-crosslinking acrylic resin material having as a main agent an acrylic acid monomer and/or oligomer; and the bond layer have a thickness of 50 μm to 200 μm, an elongation of 50% to 350%, and a light transmittance of 80% or higher in the thickness direction. It is thereby possible to provide a timepiece face created by bonding a plurality of substrates configured primarily from polycarbonate, the timepiece face having an excellent strength of bonding between substrates and occurrence of air bubbles in the bond layer being prevented in an effective manner.

The timepiece face according to the invention preferably has a first substrate, a second substrate, and a third substrate as the substrates; and a first bond layer, for bonding the first substrate and the second substrate to each other, and a second bond layer, for bonding the second substrate and the third substrate to each other, as the bond layers.

It is thereby possible to prevent the occurrence of air bubbles in the bond layers in an effective manner while maintaining an adequately high bonding strength between substrates, even in a timepiece face including three or more substrates.

In the timepiece face according to the invention, the adhesive elastic body composition, on being fashioned into a sheet material having a thickness of 7 mm, preferably has a rubber hardness of 20 to 90, and an elongation in the vertical and horizontal direction of 200% to 1500%. It is thereby possible to prevent the occurrence of air bubbles in the bond layers in a more effective manner while maintaining an adequately high bonding strength between substrates.

In the timepiece face according to the invention, the adhesive elastic body composition, on being fashioned into a sheet material having a thickness of 700 μm, preferably has an adhesive strength of 1N/25 mm width to 40 N/25 mm width. It is thereby possible to prevent the occurrence of air bubbles in the bond layers in a more effective manner while maintaining an adequately high bonding strength between substrates.

In the timepiece face according to the invention, the timepiece face preferably has a light transmittance of 10% or higher in the thickness direction. The optical transparency of the timepiece face as a whole can thereby be further improved, and e.g., the timepiece face can be applied to a solar timepiece (timepiece including a solar cell) or a similar device in a more suitable manner.

A timepiece according to the invention is includes the timepiece face of the invention. It is thereby possible to provide a timepiece including a timepiece face created by bonding a plurality of substrates; the timepiece face having an excellent strength of bonding between substrates, and occurrence of air bubbles in the bond layer being prevented in an effective manner.

Effect of the Invention

According to the invention, it is possible to provide a timepiece face created by bonding a plurality of substrates configured primarily from polycarbonate, excellent bonding strength being achieved between substrates and air bubbles being effectively prevented from forming in the bond layer; and to provide a timepiece including the timepiece face.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments of the invention will now be described with reference to the accompanying drawings. First, a description will be given for preferred embodiments of a timepiece face according to the invention.

Timepiece Face

First Embodiment

Figure 1:
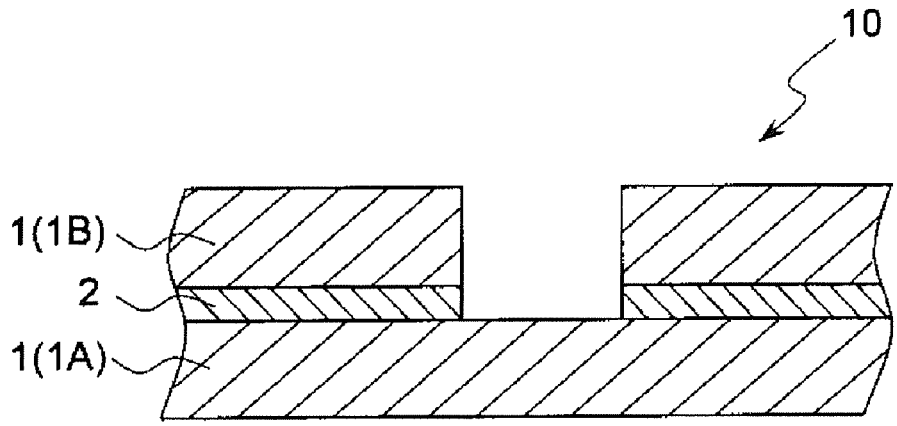
FIG. 1 is a cross-sectional view showing a first embodiment of a timepiece face according to the invention.

FIG. 1 is a cross-sectional view showing a first embodiment of a timepiece face according to the invention. In the following description, a description is given for a representative example in which the upper side shown in FIG. 1 (as well as FIGS. 2 and 3 described further below) faces the observer when the timepiece face is in use. The upper side in the drawing is referred to as "up" or "above," and the lower side is referred to as "down" or "below."

As shown in the drawing, a timepiece face 10 has a first substrate 1A and a second substrate 1B representing a plurality of substrates 1 configured primarily from polycarbonate, and a bond layer 2 for bonding the first substrate 1A and the second substrate 1B. The bond layer 2 is configured from an adhesive elastic body composition obtained by directing UV light on a UV-crosslinking acrylic resin material in an oxygen-blocked state so that crosslinking occurs, the UV-crosslinking acrylic resin material having as a main agent an acrylic acid monomer and/or oligomer. The bond layer has a thickness of 50 μm to 200 μm, an elongation of 50% to 350%, and a light transmittance of 80% or higher in the thickness direction. Thus, the timepiece face according to the invention includes a plurality of substrates configured primarily from polycarbonate and a bond layer for bonding the substrates that are adjacent, wherein the bond layer is configured from an adhesive elastic body composition obtained by directing UV light on a UV-crosslinking acrylic resin material in an oxygen-blocked state so that crosslinking occurs, the UV-crosslinking acrylic resin material having as a main agent an acrylic acid monomer and/or oligomer; and the bond layer has a thickness of 50 μm to 200 μm, an elongation of 50% to 350%, and a light transmittance of 80% or higher in the thickness direction. It is thereby possible to provide a timepiece face created by bonding a plurality of substrates configured primarily from polycarbonate, the timepiece face having an excellent strength of bonding between substrates, and occurrence of air bubbles in the bond layer being prevented in an effective manner; and to provide a timepiece provided with the timepiece face.

Substrates 1 (First Substrate 1*a*, Second Substrate 1*b*)

The timepiece face 10 includes the first substrate 1A and the second substrate 1B as a plurality of substrates 1. Including the substrates 1 makes it possible for the timepiece face 10 to have an enhanced decorative quality and three-dimensional effect. The first substrate 1A and the second substrate 1B are configured primarily from polycarbonate.

Polycarbonate is a material having excellent transparency as well as mechanical strength, and is therefore preferred as a constituent material for a timepiece face (in particular, a face of a solar timepiece). The first substrate 1A and the second substrate 1B can also contain another constituent material other than polycarbonate; for example, the substrates can contain a plasticizer, an antioxidant, a colorant (including a variety of color formers, fluorescent substances, phosphorescent substances, and similar substances), a glossing agent, a filler, or other substances. The first substrate 1A can be one having a uniform composition throughout, or can be one whose composition differs between portions (e.g., one configured from a laminated body including a plurality of layers, or one configured from a graded material whose composition varies in a graded manner in the thickness direction).

There are no particular limitations as to the polycarbonate content of the first substrate 1A and the polycarbonate content of the second substrate 1B; preferably the content is greater than or equal to 70 wt %, further preferably greater than or equal to 90 wt %, and even further preferably greater than or equal to 95 wt %. The transparency, mechanical strength, and similar properties of the timepiece face 10 as a whole can thereby be further improved.

The first substrate 1A and the second substrate 1B can have compositions that are identical to each other, or different from each other. There are no particular limitations as to the average thickness of the first substrate 1A and the average thickness of the second substrate 1B; the average thickness is preferably 50 μm to 800 μm, further preferably 80 μm to 600 μm, and even further preferably 100 μm to 500 μm. It is thereby possible to further improve the mechanical strength of the timepiece face 10, and to further improve the handleability (ease of handling) of the first substrate 1A and the second substrate 1B when the timepiece face 10 is manufactured, further improving the productivity of the timepiece face 10. The average thickness of the first substrate 1A and the second substrate 1B can be the same or different.

The first substrate 1A and the second substrate 1B have a tabular shape in the configuration shown, but can also have a curved plate shape. Also, in the configuration shown, the second substrate 1B overlaps with only a part of the first substrate 1A when the timepiece face 10 is viewed in plan view. However, the first substrate 1A and the second substrate 1B can also have an identical shape with respect to the plan view, or the first substrate 1A can overlap with only a part of the second substrate 1B.

Bond Layer

The bond layer 2 is used for bonding the two substrates 1 (the first substrate 1A and the second substrate 1B). The bond layer 2 is configured from an adhesive elastic body composition obtained by directing UV light on a UV-crosslinking acrylic resin material in an oxygen-blocked state so that crosslinking occurs, the UV-crosslinking acrylic resin material having as a main agent an acrylic acid monomer and/or oligomer; and the bond layer has a thickness of 50 μm to 200 μm, an elongation of 50% to 350%, and a light transmittance of 80% or higher in the thickness direction. The bond layer 2 having a configuration of such description makes it possible to bond adjacent substrates 1 (the first substrate 1A and the second substrate 1B) in a reliable manner; to prevent air bubbles from entering between the substrates 1 (the first substrate 1A and the second substrate 1B) in a reliable manner while maintaining sufficiently excellent shape stability and mechanical strength of the timepiece face 10 as a whole; and, as a result, to obtain an excellent aesthetic appearance for the timepiece face 10 in a reliable manner. Also, a bond layer of such description is excellent in terms of light resistance and outgassing, and can maintain an excellent aesthetic appearance and other qualities over a long period in a stable manner. In other words, the bond layer is excellent in terms of timepiece face durability. The excellent effects of such description are obtained by the bond layer satisfying each of the above-mentioned conditions, and cannot be obtained if even one of the above-mentioned conditions is not satisfied.

Examples of an acrylic acid monomer and/or oligomer used as a main agent include acrylic acid, ethyl acrylate, methyl acrylate, 2-ethylhexyl acrylate, butyl acrylate, isobutyl acrylate, isononyl acrylate, dimethylaminoethyl acrylate, methoxyethyl acrylate, stearyl acrylate, isooctyl acrylate, N-octyl acrylate, 2-hydroxyethyl acrylate, hydroxypropyl acrylate, methyl methacrylate, butyl methacrylate, 2-hydroxyethyl methacrylate, 2-hydroxypropyl methacrylate, cyclohexyl methacrylate, trimethylolpropane trimethacrylate, tertiary butyl methacrylate, and other substances. One or more types of substances selected from the above can be used in combination.

Other than the acrylic acid monomer and/or oligomer used as the main agent, a UV crosslinking initiator, a UV crosslink accelerator (sensitizer), and other auxiliary materials can be mixed to the UV-crosslinking acrylic resin material, from which the adhesive elastic body composition is obtained by UV irradiation. The adhesive elastic body composition, on being formed into a sheet material having a thickness of 7 mm, preferably has a rubber hardness of 20 to 90, and an elongation in the vertical and horizontal direction of 200% to 1500%. Occurrence of air bubbles in the bond layer 2 can thereby be prevented in a more effective manner while an adequately high bonding strength between the substrates 1 (strength of bonding between the first substrate 1A and the second substrate 1B) is maintained. In the present specifications, "elongation" refers to the elongation measured under conditions compliant with JIS Z 0237.

When formed into a sheet material having a thickness of 700 μm, the adhesive elastic body composition has an adhesive strength of preferably 1N/25 mm width to 40 N/25 mm width, and further preferably 5N/25 mm width to 35 N/25 mm width (obtained by measurement compliant with JIS-Z-0237). It is thereby possible to prevent the occurrence of air bubbles in the bond layer in a more effective manner while maintaining an adequately high bonding strength between the substrates.

The thickness of the bond layer 2 can be 50 μm to 200 μm, but is preferably 50 μm to 100 μm. The effect of the invention described above is thereby exhibited more prominently. The elongation of the bond layer 2 can be 50% to 350%, but is preferably 60% to 250%. The effect of the invention described above is thereby exhibited more prominently.

Light transmittance of the bond layer 2 in the thickness direction can be 80% or higher, but is preferably 90% or higher. Optical transparency of the timepiece face 10 as a whole can thereby be further improved, and e.g., the timepiece face 10 can be applied to a solar timepiece (timepiece including a solar cell) or a similar device in a more suitable manner. In the configuration shown, the bond layer 2 is provided to the whole of a region in which the first substrate 1A and the second substrate 1B overlap. However, the bond layer 2 need only be provided to at least a part of the region in which the first substrate 1A and the second substrate 1B overlap.

The bond layer 2 described above can, e.g., be formed as follows.

(1) Coating on Film

The acrylic resin material (UV-crosslinking acrylic resin material) whose main agent is the acrylic acid monomer and/or oligomer described above is extruded using an extruder, a die coater, or another device; and laminated onto a PET film or another film. As for the film onto which the acrylic resin material is laminated, direct application onto the substrates 1 (first substrate 1A and second substrate 1B) can be performed. Alternatively, a procedure can be performed such as applying the substrates 1 (first substrate 1A and second substrate 1B) described further below, either before UV irradiation or after UV irradiation, onto the acrylic resin material coated onto process paper (process film).

The thickness of the extruded UV-crosslinking acrylic resin material can be adjusted using an extrusion die of the extruder or using a comma coater, a reverse coater, a knife coater, or a similar device. However, adjustment is preferably performed using the extrusion die from the viewpoint of preventing occurrence of air bubbles and preventing adhesion or entrainment of foreign objects. In an instance in which the film used here also functions as a gas barrier film described in a UV irradiation step described further below, a film having a gas barrier property, and preferably having UV transparency, is used.

For the film, a biaxially stretched PET film is preferably used from the viewpoint of gas barrier property, surface smoothness, dimensional stability, and other properties; however, a polypropylene or another olefin-based film can also be used. In an instance in which the film (process film) used for coating with the acrylic resin material is to be later removed, it is preferable that releasability is exhibited by one or both surfaces. It is preferable that a film coated with a silicone-based release agent is used so that such releasability is exhibited.

(2) UV Irradiation Step

The acrylic resin material coated on a film as described above is irradiated with UV light and crosslinking is induced; and an adhesive elastic body composition exhibiting adhesive property and elasticity is obtained. The UV irradiation step is performed in a state in which oxygen is blocked, e.g., in a space in which air has been replaced by nitrogen gas or another gas, or in a state in which both surfaces of the acrylic resin material are covered by a film having a gas barrier property.

In an instance in which a film having a gas barrier property is used as the aforementioned film laminated with the acrylic resin material, a surface of the acrylic resin material opposite the surface to which the film has been bonded is also affixed with a gas barrier film in advance before UV irradiation. For the gas barrier film, any of a film based on PE, PP, or another olefin; a PET film; a paper-resin laminate; coated paper; or any other material can be used as long as the oxygen permeability is equal to or less than 10,000 cc/cm$^2$ (24 hr, 20° C., 90% RH) in accordance with JIS-K-7126. However, use of a stretched PET film is preferable from the viewpoint of compatibility with heat rays of the UV lamp, gas barrier property, smoothness of finished surface, and other properties. In an instance in which UV irradiation is performed from the side of the gas barrier film, a gas barrier film having UV transparency is used.

The timepiece face 10 preferably has a light transmittance of 10% or higher in the thickness direction, and further preferably has a light transmittance of 12% or higher in the thickness direction. The optical transparency of the timepiece face 10 as a whole can thereby be further improved, and, e.g., the timepiece face 10 can be applied to a solar timepiece (timepiece including a solar cell) or a similar device in a more suitable manner. The thickness of the timepiece face 10 is preferably 250 μm to 1500 μm, and further preferably 300 μm to 1000 μm.

Second Embodiment

Figure 2:
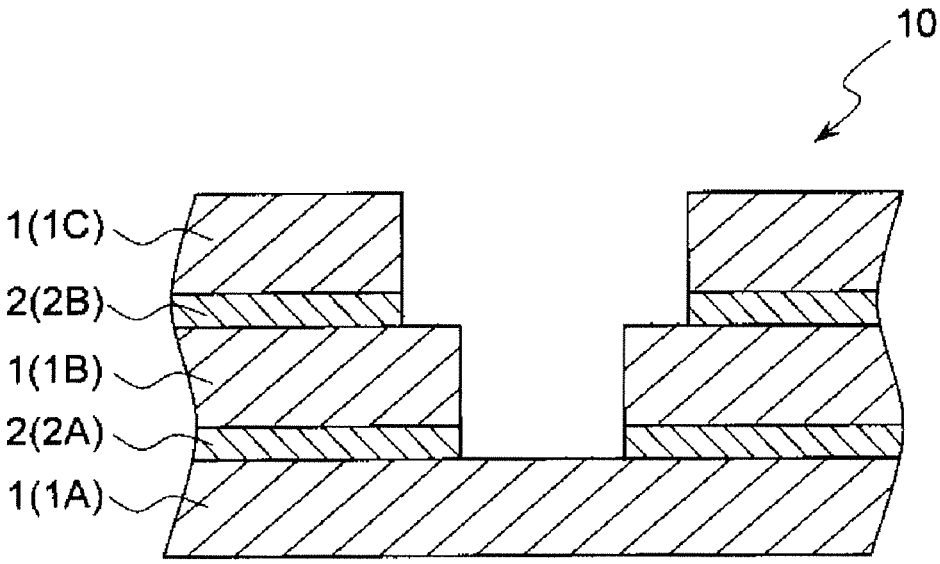
FIG. 2 is a cross-sectional view showing a second embodiment of the timepiece face according to the invention.

FIG. 2 is a cross-sectional view showing a second embodiment of the timepiece face according to the invention. The timepiece face according to the second embodiment will be described mainly with regards to differences relative to the previous embodiment, and a description of elements that are similar shall not be provided. The timepiece face 10 according to the present embodiment has a structure in which a first substrate 1A configured primarily from polycarbonate, a first bond layer 2A, a second substrate 1B configured primarily from polycarbonate, a second bond layer 2B, and a third substrate 1C configured primarily from polycarbonate are laminated in the above sequence. In other words, the timepiece face 10 has the first substrate 1A, the second substrate 1B, and the third substrate 1C as substrates 1; and has the first bond layer 2A, for bonding the first substrate 1A and the second substrate 1B to each other, and the second bond layer 2B, for bonding the second substrate 1B and the third substrate 1C to each other, as bond layers 2. Thus, in the invention, even in a timepiece face including three or more substrates, it is possible to prevent the occurrence of air bubbles in the bond layers in an effective manner while maintaining an adequately high bonding strength between the substrates.

Also, in the present embodiment, the number of laminations of the substrates 1 is greater than in the aforementioned first embodiment. Therefore, the external appearance of the timepiece face 10 can be endowed with an even richer three-dimensional appearance. In an instance such as in the present embodiment where the timepiece face has the first substrate 1A, the second substrate 1B, and the third substrate 1C as substrates 1, there are no particular limitations as to the average thickness of the first substrate 1A, the average thickness of the second substrate 1B, and the average thickness of the third substrate 1C; the average thickness is preferably 50 μm to 800 μm, further preferably 60 μm to 600 μm, and even further preferably 80 μm to 500 μm. It is thereby possible to further improve the mechanical strength of the timepiece face 10, and to further improve the handleability (ease of handling) of the first substrate 1A, the second substrate 1B, and the third substrate 1C during manufacture of the timepiece face 10, further improving the productivity of the timepiece face 10. The average thickness of the first substrate 1A, the second substrate 1B, and the third substrate 1C can be the same or different.

Timepiece

A description will now be given for a timepiece according to the invention, including the timepiece face according to the invention described above. A timepiece according to the invention has the timepiece face according to the invention described above. As described above, the timepiece face according to the invention is created by bonding a plurality of substrates; excellent bonding strength being achieved between substrates and air bubbles being effectively prevented from forming in the bond layer. Therefore, it is possible to obtain an excellent external appearance and durability with regards to the timepiece as a whole. Also, both the constituent material of the substrates (polycarbonate) and the constituent material of the bond layers (crosslinked UV-crosslinking acrylic resin material) have excellent optical transparency; therefore, the optical transparency of the timepiece face 10 as a whole can be improved. Therefore, a timepiece according to the invention including a timepiece face of such description sufficiently satisfies requirements needed for a solar timepiece. Known components can be used for the components forming the timepiece according to the invention other than the timepiece face (the timepiece face according to the invention). However, an example of a configuration of a timepiece according to the invention will now be described.

Figure 3:
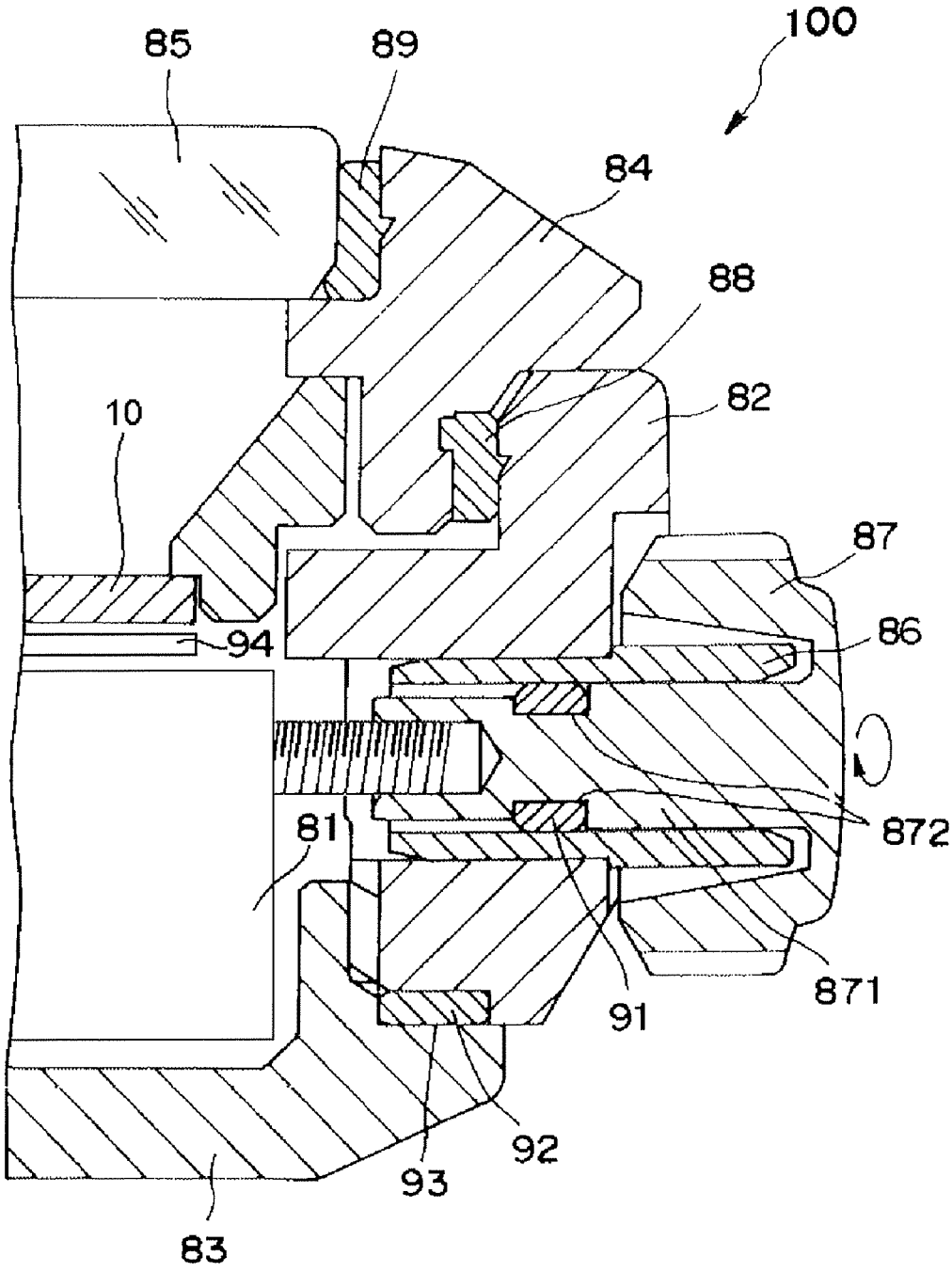
FIG. 3 is a partial cross-sectional view showing a preferred embodiment of a timepiece (portable timepiece) according to the invention.

FIG. 3 is a partial cross-sectional view showing a preferred embodiment of a timepiece (a wristwatch) according to the invention. As shown in FIG. 3, a wristwatch (portable timepiece) 100 according to the present embodiment includes a case 82, a back lid 83, a bezel (rim) 84, and a glass plate (cover glass) 85. The timepiece face 10 of the invention described above, a solar cell 94, and a movement 81 are accommodated in the case 82, and needles (hands) and other components that are not shown are also accommodated in the case 82, The timepiece face 10 is provided between the solar cell 94 and the glass plate (cover glass) 85. The glass plate 85 is normally configured from transparent glass, sapphire, or another material having a high transparency. It is thereby possible to allow the aesthetic quality of the timepiece face 10 of the invention to be adequately exhibited, and to cause a sufficient amount of light to be incident on the solar cell 94.

The movement 81 uses the electromotive force of the solar cell 94 to drive the hands. Although not shown in FIG. 3, the movement 81 internally includes, e.g., an electric double-layer capacitor or a lithium-ion rechargeable battery for storing the electromotive force of the solar cell 94; a crystal oscillator used as a source of time reference; a semiconductor integrated circuit for generating a driving pulse for driving the timepiece on the basis of the oscillation frequency of the crystal oscillator; a step motor for receiving the driving pulse and driving the hands every second; a wheel train mechanism for transmitting the movement of the step motor to the hands; and other components. The movement 81 includes an antenna (not shown) for receiving radio waves, and has a function of adjusting time or performing a similar operation using the received radio waves.

The solar cell 94 has a function of converting light energy into electrical energy. Electrical energy converted in the solar cell 94 is used, e.g., to drive the movement. The solar cell 94 has, e.g., a p-i-n structure in which a p-type impurity and an n-type impurity are selectively introduced in a non-single crystalline silicon thin film, and an i-type non-crystalline silicon thin film having a low impurity concentration is provided between a p-type non-single crystalline silicon thin film and an n-type non-single crystalline silicon thin film.

A stem pipe 86 is fitted into and secured in the case 82. A shaft section 871 of a winder 87 is inserted into the stem pipe 86 so as to be capable of rotating. The case 82 and the bezel 84 are secured by a plastic packing 88, and the bezel 84 and the glass plate 85 are secured by a plastic packing 89. The back lid 83 is fitted (or screwed) onto the case 82. A ring-shaped rubber packing (back lid packing) 92 is interposed therebetween, in a compressed state, in a bond part (seal part) 93. This configuration seals the seal part 93 in a watertight manner, and a waterproofing function is obtained.

A groove 872 is formed on an outer periphery partway along the shaft section 871 of the winder 87. A ring-shaped rubber packing (winder packing) 91 is fitted into the groove 872. The rubber packing 91 is in intimate contact with an inner peripheral surface of the stem pipe 86, and is compressed between the inner peripheral surface and an inner surface of the groove 872. This configuration seals a gap between the winder 87 and the stem pipe 86 in a watertight manner, and a waterproofing function is obtained. When the winder 87 is operated so as to rotate, the rubber packing 91 rotates with the shaft section 871, and slides in the circumferential direction while being in intimate contact with the inner peripheral surface of the stem pipe 86.

In the above description, a wristwatch (portable timepiece) that is a solar radio timepiece is given as an example of a timepiece. However, the invention can be similarly applied to a table timepiece; a wall timepiece, a portable timepiece other than a wristwatch, or another type of timepiece. The invention can also be applied to a solar timepiece other than a solar radio timepiece, a radio timepiece other than a solar radio timepiece, or any other type of timepiece.

Although preferred embodiments of the invention have been described, the invention is not limited to those described above. For example, in the timepiece face and the timepiece according to the invention, the configuration of each of the parts can be substituted with a desired configuration exhibiting a similar function, and can also be added with a desired configuration. For example, the timepiece face and the timepiece can also have a printed part formed by a variety of printing methods. Also, in the aforementioned embodiments, a description was given for a representative configuration in which the timepiece face includes two or three substrates configured primarily from polycarbonate. However, the timepiece face according to the invention can also include four or more substrates.

EXAMPLES

Specific examples of the invention will now be described.

1. Preparation of Sheet-Form Adhesive Elastic Body Composition

First Preparation Example

First, a UV-crosslinking acrylic resin material containing 100 weight parts of 2-ethylhexyl acrylate, 20 weight parts of acrylic acid, and 0.4 weight parts of an acetophenone-based photo-radical polymerization initiator (Ciba Specialty Chemicals; Irgacure 184) was applied, using a die coater, onto a biaxially stretched polyethylene terephthalate (PET) film (process film) having a thickness of 188 μm and coated with a silicone-based release agent, so that the thickness of the bond layer is 70 μm. The oxygen permeability of the film was equal to or less than 10,000 cc/cm$^2$(24 hr, 20° C., 90% RH) in accordance with JIS-K-7126.

Next, a surface of the UV-crosslinking acrylic resin material applied onto the process film was covered with a biaxially stretched polyethylene terephthalate (PET) film having a thickness of 25 μm and coated with a silicone-based release agent. The oxygen permeability of the film was equal to or less than 10,000 cc/cm$^2$ (24 hr, 20° C., 90% RH) in accordance with "JIS-K-7126". Next, the laminated body including the two films and the UV-crosslinking acrylic resin material was irradiated with UV light in a chamber substituted with nitrogen gas. UV irradiation was performed using a mercury lamp having a peak wavelength of 365 nm at 500 mW/cm$^2$ for an irradiation time of 1 minute. A sheet-form adhesive elastic body composition covered by two films was thereby obtained.

The sheet-form adhesive elastic body composition obtained in the present preparation example had an elongation of 250% and a light transmittance of 91% in the thickness direction. When the sheet-form adhesive elastic body composition obtained in the present preparation example was laminated onto a sheet material having a thickness of 7 mm, the rubber hardness was 65. When the sheet-form adhesive elastic body composition obtained in the present preparation example was laminated onto a sheet material having a thickness of 7 mm, the elongation in the vertical and lateral direction was 250%. When the sheet-form adhesive elastic body composition obtained in the present preparation example was laminated onto a sheet material having a thickness of 700 μm, the adhesive strength (value obtained by measurement compliant with JIS-Z-0237) was 12 N/25 mm width.

Second Preparation Example

First, a UV-crosslinking acrylic resin material containing 100 weight parts of 2-ethylhexyl acrylate, 40 weight parts of methacrylic acid, 5 weight parts of urethane acrylate, and 0.4 weight parts of an acetophenone-based photo-radical polymerization initiator (Ciba Specialty Chemicals; Irgacure 184) was applied, using a die coater, onto a biaxially stretched polyethylene terephthalate (PET) film (process film) having a thickness of 188 μm and coated with a silicone-based release agent, so that the thickness of the bond layer is 50 μm. The oxygen permeability of the film was equal to or less than 10,000 cc/cm$^2$(24 hr, 20° C., 90% RH) in accordance with "JIS-K-7126".

Next, a surface of the UV-crosslinking acrylic resin material applied onto the process film was covered with a biaxially stretched polyethylene terephthalate (PET) film having a thickness of 25 μm and coated with a silicone-based release agent. The oxygen permeability of the film was equal to or less than 10,000 cc/cm$^2$(24 hr, 20° C., 90% RH) in accordance with "JIS-K-7126". Next, the laminated body including the two films and the UV-crosslinking acrylic resin material was irradiated with UV light in a chamber substituted with nitrogen gas. UV irradiation was performed using a mercury lamp having a peak wavelength of 200 nm at 200 mW/cm$^2$ for an irradiation time of 1 minute. A sheet-form adhesive elastic body composition covered by two films was thereby obtained.

The sheet-form adhesive elastic body composition obtained in the present preparation example had an elongation of 180% and a light transmittance of 89% in the thickness direction. When the sheet-form adhesive elastic body composition obtained in the present preparation example was laminated onto a sheet material having a thickness of 7 mm, the rubber hardness was 75. When the sheet-form adhesive elastic body composition obtained in the present preparation example was laminated onto a sheet material having a thickness of 7 mm, the elongation in the vertical and lateral direction was 180%. When the sheet-form adhesive elastic body composition obtained in the present preparation example was laminated onto a sheet material having a thickness of 700 μm, the adhesive strength (value obtained by measurement compliant with JIS-Z-0237) was 18 N/25 mm width.

Third Preparation Example

First, a UV-crosslinking acrylic resin material containing 100 weight parts of butyl acrylate, 50 weight parts of acrylic acid, 5 weight parts of urethane acrylate, and 0.4 weight parts of an acetophenone-based photo-radical polymerization initiator (Ciba Specialty Chemicals; Irgacure 184) was applied, using a die coater, onto a biaxially stretched polyethylene terephthalate (PET) film (process film) having a thickness of 188 μm and coated with a silicone-based release agent, so that the thickness of the bond layer is 100 μm. The oxygen permeability of the film was equal to or less than 10,000 cc/cm$^2$ (24 hr, 20° C., 90% RH) in accordance with "JIS-K-7126".

Next, a surface of the UV-crosslinking acrylic resin material applied onto the process film was covered with a biaxially stretched polyethylene terephthalate (PET) film having a thickness of 25 μm and coated with a silicone-based release agent. The oxygen permeability of the film was equal to or less than 10,000 cc/cm$^2$(24 hr, 20° C., 90% RH) in accordance with "JIS-K-7126". Next, the laminated body including the two films and the UV-crosslinking acrylic resin material was irradiated with UV light in a chamber substituted with nitrogen gas. UV irradiation was performed using a mercury lamp having a peak wavelength of 328 nm at 500 mW/cm$^2$ for an irradiation time of 3 minutes. A sheet-form adhesive elastic body composition covered by two films was thereby obtained.

The sheet-form adhesive elastic body composition obtained in the present preparation example had an elongation of 240% and a light transmittance of 90% in the thickness direction. When the sheet-form adhesive elastic body composition obtained in the present preparation example was laminated onto a sheet material having a thickness of 7 mm, the rubber hardness was 40. When the sheet-form adhesive elastic body composition obtained in the present preparation example was laminated onto a sheet material having a thickness of 7 mm, the elongation in the vertical and lateral direction was 240%. When the sheet-form adhesive elastic body composition obtained in the present preparation example was laminated onto a sheet material having a thickness of 700 μm, the adhesive strength (value obtained by measurement compliant with JIS-Z-0237) was 22 N/25 mm width.

Fourth Preparation Example

A sheet-form adhesive elastic body composition covered by two films was obtained in a similar manner to the aforementioned first preparation example except that the amount of UV-crosslinking acrylic resin material applied onto the process film was changed so that the thickness of the bond layer was 40 μm.

Fifth Preparation Example

A sheet-form adhesive elastic body composition covered by two films was obtained in a similar manner to the aforementioned first preparation example except that the amount of UV-crosslinking acrylic resin material applied onto the process film was changed so that the thickness of the bond layer was 210 μm.

Sixth Preparation Example

A sheet-form adhesive elastic body composition covered by two films was obtained in a similar manner to the aforementioned first preparation example except that the mixture ratio of each of the components was changed so that the elongation of the bond layer was 10%.

Seventh Preparation Example

A sheet-form adhesive elastic body composition covered by two films was obtained in a similar manner to the aforementioned first preparation example except that the mixture ratio of each of the components was changed so that the elongation of the bond layer was 500%.

Eighth Preparation Example

Next, a sheet-form adhesive elastic body composition covered by two films was obtained in a similar manner to the aforementioned first preparation example except that UV irradiation was performed in air (i.e., under an atmosphere containing oxygen), without the surface of the UV-crosslinking acrylic resin material applied onto the process film being itself covered with a film.

2. Manufacture of Timepiece Face

A timepiece face (wristwatch face) was manufactured for each example and comparative example according to the method shown below.

First Example

First, a disk-shaped base material was created by injection molding using polycarbonate. Then, a required portion was die-cut and unnecessary burrs and similar sections were cut off and polished, whereby multiple substrates were obtained.

The resulting substrate had a diameter of 27 mm and an average thickness of 200 μm, and had a hole, at a center part in plan view, through which a shaft of the hands (hour hand, minute hand, and second hand) is passed. The resulting substrate was used as the first substrate. Then, a substrate of the above description (first substrate) was perforated by punching to form a hole at a portion other than the hole through which the shaft of the hands (hour hand, minute hand, and second hand) is passed at a center part in plan view. The second substrate was thereby obtained.

Meanwhile, the laminated body obtained in the above-mentioned first preparation example was perforated by punching so as to obtain a shape identical to that of the second substrate. One of the films was peeled from the laminated body perforated by punching as described above, and the exposed UV-crosslinking acrylic resin material was affixed onto the second substrate so as to be in intimate contact. Then, the other film was peeled, and the exposed UV-crosslinking acrylic resin material was affixed onto the first substrate so as to be in intimate contact. A timepiece face as shown in FIG. 1, in which the first substrate and the second substrate are laminated in the above sequence, was thereby obtained.

Second Through Seventh Examples

Timepiece faces were manufactured in a similar manner to that for the first example, except that the type of laminated body includes the sheet-form adhesive elastic body composition used to form the bond layer, the thickness of the first substrate, and the thickness of the second substrate were as shown in Table 1.

First Comparative Example

A timepiece face was manufactured in a similar manner to that for the first example, except that a first substrate configured from polypropylene was used instead of one configured from polycarbonate.

Second Comparative Example

A timepiece face was manufactured in a similar manner to that for the first example, except that a second substrate configured from polypropylene was used instead of one configured from polycarbonate.

Third Comparative Example

A timepiece face was manufactured in a similar manner to that for the first example, except that first and second substrates configured from polypropylene were used instead of those configured from polycarbonate.

Fourth Through Eighth Comparative Examples

Timepiece faces were manufactured in a similar manner to that for the first example, except that the type of laminated body including the sheet-form adhesive elastic body composition used to form the bond layer was as shown in Table 1.

Ninth Comparative Example

A timepiece face was manufactured in a similar manner to that for the first example, except that a commercially available double-sided tape (Sumitomo 3M; 4511-50) was used, instead of the sheet-form adhesive elastic body composition, to form the bond layer.

Tenth Comparative Example

A timepiece face was manufactured in a similar manner to that for the first example, except that a commercially available double-sided tape (Nitto Denko, CS9622T) was used, instead of the sheet-form adhesive elastic body composition, to form the bond layer.

Eleventh Comparative Example

A timepiece face was manufactured in a similar manner to that for the first example, except that a commercially available double-sided tape (Kyodo Giken Chemical; 200A50) was used, instead of the sheet-form adhesive elastic body composition, to form the bond layer.

The configuration of each of the examples and the comparative examples is shown together in Table 1. In the table, polycarbonate is represented by "PC", polypropylene resin is represented by "PP," 4511-50 (Sumitomo 3M) is represented by "53M," CS9622T (Nitto Denko) is represented by "NTD," and 200A50 (Kyodo Giken Chemical) is represented by "KGK." In all instances, the first substrate and the second substrate configuring the timepiece face were configured using the substance shown in Table 1 as a primary component, and the amount of other components present was less than 0.1 wt %.

TABLE 1

| | First Substrate | | Second Substrate | | Bond Layer | |
|---|---|---|---|---|---|---|
| | Constituent material | Average thickness (μm) | Constituent material | Average thickness (μm) | Type | Average thickness (μm) |
| Example 1 | PC | 200 | PC | 200 | Preparation Example 1 | 70 |
| Example 2 | PC | 250 | PC | 150 | Preparation Example 2 | 50 |
| Example 3 | PC | 200 | PC | 100 | Preparation Example 3 | 200 |
| Example 4 | PC | 330 | PC | 90 | Preparation Example 1 | 70 |
| Example 5 | PC | 90 | PC | 330 | Preparation Example 1 | 70 |
| Example 6 | PC | 380 | PC | 70 | Preparation Example 1 | 70 |
| Example 7 | PC | 70 | PC | 380 | Preparation Example 1 | 70 |
| Comparative Example 1 | PP | 200 | PC | 200 | Preparation Example 1 | 70 |
| Comparative Example 2 | PC | 200 | PP | 200 | Preparation Example 1 | 70 |
| Comparative Example 3 | PP | 200 | PP | 200 | Preparation Example 1 | 70 |
| Comparative Example 4 | PC | 200 | PC | 200 | Preparation Example 4 | 40 |
| Comparative Example 5 | PC | 200 | PC | 200 | Preparation Example 5 | 210 |
| Comparative Example 6 | PC | 200 | PC | 200 | Preparation Example 6 | 70 |
| Comparative Example 7 | PC | 200 | PC | 200 | Preparation Example 7 | 70 |
| Comparative Example 8 | PC | 200 | PC | 200 | Preparation Example 8 | 70 |
| Comparative Example 9 | PC | 200 | PC | 200 | S3M | 50 |
| Comparative Example 10 | PC | 200 | PC | 200 | NTD | 50 |
| Comparative Example 11 | PC | 200 | PC | 200 | KGK | 50 |

3. Evaluation of External Appearance of Wristwatch Face

Each of the wristwatch faces manufactured in each of the examples and the comparative examples was visually observed from the side of the second substrate immediately after manufacture and after performing a heating treatment of 60° C. for 24 hours. The observed external appearance was evaluated according to the following six-staged criteria.

A: Of the utmost exceptional external appearance; no air bubbles observed at all.

B: Highly exceptional external appearance; almost no air bubbles observed.

C: Exceptional external appearance, despite a few air bubbles being observed.

D: Good external appearance; air bubbles observed.

E: Fairly poor external appearance; air bubbles clearly observed.

F: Poor external appearance; air bubbles prominently observed.

4. Bond Strength

The strength of bonding between the substrates, in relation to each of the wristwatch faces manufactured in each of the examples and comparative examples, was evaluated using the following method. First, a timepiece (wristwatch) as shown in FIG. 3 was assembled using each of the wristwatch faces manufactured in each of the examples and comparative examples. A timepiece thus obtained was dropped from a height of 1000 mm onto an oak board having a thickness of 20 mm. The wristwatch face was observed, and the appearance of the wristwatch face was evaluated according to the following six-staged criteria.

A: Of the utmost exceptional external appearance; no change in external appearance observed at all.

B: Highly exceptional external appearance; almost no change in external appearance observed.

C: Exceptional external appearance, despite a slight change in external appearance being observed.

D: Good external appearance; small cracking observed.

E: Fairly poor external appearance; cracking clearly observed.

F: Poor external appearance; cracking and peeling portion prominently observed.

5. Light Resistance

The light resistance, in relation to each of the wristwatch faces manufactured in each of the examples and comparative examples, was evaluated using the following method. The wristwatch face was observed after 100 hours of UV fade meter testing, and the appearance of the wristwatch face was evaluated according to the following six-staged criteria.

A: Of the utmost exceptional external appearance; no change in external appearance observed at all.

B: Highly exceptional external appearance; almost no change in external appearance observed.

C: Exceptional external appearance; despite a slight change in external appearance being observed.

D: Good external appearance; slight discoloration observed.

E: Fairly poor external appearance; discoloration clearly observed.

F: Poor external appearance; discoloration or peeling prominently observed.

6. Evaluation of Light Transmittance of Wristwatch Face

The light transmittance, in relation to each of the wristwatch faces manufactured in each of the examples and comparative examples, was evaluated using the following method. First, a solar cell and each of the wristwatch faces were placed in a darkroom. Then, using the solar cell on its own, light from a white fluorescent lamp (light source) positioned at a predetermined distance was emitted onto a light-receiving surface of the solar cell. The current generated by the solar cell in this instance is represented by A[mA]. Next, light from the white fluorescent lamp (light source) positioned at a predetermined distance was similarly emitted onto the light-receiving surface of the solar cell in a state in which the wristwatch face was overlapped with an upper surface of the light-receiving surface of the solar cell. The current generated by the solar cell in this state is represented by B[mA]. The light transmittance of the timepiece face, represented by $(B/A)\times 100$, was calculated, and evaluated according to the following two-staged criteria. Optical transparency of the timepiece face was regarded to be superior in correspondence with increasing light transmittance. Each of the timepiece faces of each of the examples and comparative examples was overlapped onto the solar cell so that a surface on which the dial is provided faces towards the white fluorescent lamp (light source).

A: 40% or above

B: Less than 40%

7. Evaluation of Radio Transparency

The radio transparency, in relation to each of the timepiece faces manufactured in each of the examples and comparative examples, was evaluated using the following method. First, a timepiece case and an internal wristwatch module (movement) including an antenna for receiving radio waves were readied.

Next, the internal wristwatch module (movement) and the wristwatch face were installed in the timepiece case, and the radio reception sensitivity was measured in this state. At this point, each of the timepiece faces manufactured in each of the examples and comparative examples was oriented so that the surface on which the dial is provided faces towards an outer surface. Using the reception sensitivity in a state in which no wristwatch face has been installed as a reference, the amount by which the reception sensitivity decreases (dB) when the wristwatch face has been installed was evaluated according to the following four-staged criteria. Radio transparency of the wristwatch face was regarded to be superior with a smaller decrease in the radio reception sensitivity.

A: No observable decrease in sensitivity (i.e., equal to or less than limit of detection)

B: Observable decrease in sensitivity of less than 0.7 dB.

C: Decrease in sensitivity equal to or greater than 0.7 dB and less than 1.0 dB.

D: Decrease in sensitivity equal to or greater than 1.0 dB.

The results of the above are shown in Table 2.

TABLE 2

| | External appearance evaluation | | | | | |
|---|---|---|---|---|---|---|
| | Immediately after manufacture | After heating treatment | Bond strength | Light resistance | Optical transparency | Radio transparency |
| Example 1 | A | A | A | A | A | A |
| Example 2 | A | A | A | A | A | A |
| Example 3 | B | B | A | A | A | A |
| Example 4 | A | A | A | A | A | A |
| Example 5 | A | A | A | A | A | A |
| Example 6 | A | A | A | A | A | A |
| Example 7 | A | A | A | A | A | A |
| Comparative Example 1 | A | C | A | F | A | A |
| Comparative Example 2 | A | C | A | F | A | A |
| Comparative Example 3 | D | E | A | A | A | A |
| Comparative Example 4 | D | E | A | A | A | A |
| Comparative Example 5 | D | E | A | A | A | A |
| Comparative Example 6 | D | E | A | A | A | A |
| Comparative Example 7 | A | A | A | A | A | A |
| Comparative Example 8 | E | F | E | A | A | A |
| Comparative Example 9 | A | F | C | F | A | A |
| Comparative Example 10 | F | F | C | F | A | A |
| Comparative Example 11 | E | E | C | E | A | A |

As can be seen from Table 2, the timepiece face of the invention has an exceptionally aesthetic appearance where air bubble infiltration and other factors contributing to disfigurement are prevented in a reliable manner, and demonstrates excellent strength of bonding between substrates. Additionally, the timepiece face of the invention has excellent light resistance with minimal outgassing. The timepiece face of the invention also has excellent optical transparency and radio transparency. In contrast, satisfactory results were not obtained in the comparative examples. Also, a timepiece as shown in FIG. 3 was assembled using the timepiece face obtained in each of the examples and comparative examples. When experiments and evaluations similar to those described above were performed on each of the timepieces thus obtained, results similar to those described above were obtained.

What is claimed is:

1. A timepiece face, comprising:

a first substrate configured primarily from polycarbonate;

a second substrate configured primarily from polycarbonate; and a bond layer for bonding the first substrate and the second substrate; wherein the bond layer is configured from an adhesive elastic body composition obtained by directing UV light on a UV-crosslinking acrylic resin material in an oxygen-blocked state so that crosslinking occurs, the UV-crosslinking acrylic resin material having as a main agent an acrylic acid monomer and/or oligomer; and the bond layer has a thickness of 50 μm to 200 μm, an elongation of 50% to 350%, and a light transmittance of 80% or higher in the thickness direction.

2. A timepiece face, comprising:

a plurality of substrates configured primarily from polycarbonate; and bond layers for bonding the substrates that are adjacent; wherein the bond layers are configured from an adhesive elastic body composition obtained by directing UV light on a UV-crosslinking acrylic resin material in an oxygen-blocked state so that crosslinking occurs, the UV-crosslinking acrylic resin material having as a main agent an acrylic acid monomer and/or oligomer; and the bond layer have a thickness of 50 μm to 200 μm, an elongation of 50% to 350%, and a light transmittance of 80% or higher in the thickness direction.

3. The timepiece face according to claim 2, further comprising a first substrate, a second substrate, and a third substrate as the substrates; and a first bond layer, for bonding the first substrate and the second substrate, and a second bond layer, for bonding the second substrate and the third substrate, as the bond layers.

4. The timepiece face according to claim 1, wherein the adhesive elastic body composition, on being fashioned into a sheet material having a thickness of 7 mm, has a rubber hardness of 20 to 90, and an elongation in the vertical and horizontal direction of 200% to 1500%.

5. The timepiece face according to claim 1, wherein the adhesive elastic body composition, on being fashioned into a sheet material having a thickness of 700 μm, has an adhesive strength of 1N/25-mm width to 40 N/25-mm width.

6. The timepiece face according to claim 1, wherein the timepiece face has a light transmittance of 10% or higher in the thickness direction.

7. A timepiece including the timepiece face according to claim 1.

* * * * *